US007033230B2

(12) United States Patent
Horiuchi

(10) Patent No.: US 7,033,230 B2
(45) Date of Patent: Apr. 25, 2006

(54) CONNECTOR

(75) Inventor: Masaya Horiuchi, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/023,246

(22) Filed: Dec. 27, 2004

(65) Prior Publication Data

US 2005/0142923 A1 Jun. 30, 2005

(30) Foreign Application Priority Data

Dec. 25, 2003 (JP) ..... 2003-430299

(51) Int. Cl.
*H01R 13/514* (2006.01)

(52) U.S. Cl. ..... 439/752

(58) Field of Classification Search ..... 439/350–354, 439/595, 752, 356–358
See application file for complete search history.

(56) References Cited

U.S. PATENT DOCUMENTS 4,714,433 A * 12/1987 Rider, Jr. ..... 439/310
4,801,275 A * 1/1989 Ikeda et al. ..... 439/350
4,986,766 A * 1/1991 Leonard et al. ..... 439/352
5,234,356 A * 8/1993 Maejima et al. ..... 439/352
5,254,014 A * 10/1993 Yagi et al. ..... 439/353
5,380,217 A * 1/1995 Yagi et al. ..... 439/358
5,391,090 A * 2/1995 Power ..... 439/354
5,588,872 A * 12/1996 Fukuda ..... 439/489
5,643,003 A * 7/1997 Myer et al. ..... 439/352
5,664,961 A * 9/1997 Tsuji et al. ..... 439/358
6,341,973 B1 * 1/2002 Endo ..... 439/352
6,371,796 B1 * 4/2002 Fukuda ..... 439/489
6,676,433 B1 * 1/2004 Ozaki ..... 439/353

FOREIGN PATENT DOCUMENTS

JP 2001-319732 11/2001

* cited by examiner

*Primary Examiner*—Alexander Gilman
(74) *Attorney, Agent, or Firm*—Gerald E. Hespos; Anthony J. Casella

(57) ABSTRACT

Two support walls (26) stand at the opposite sides of a rear part of a lock arm (24) at a rear part of a housing (10). Deforming pieces (25) extending to left and right from a rear end portion of the lock arm (24) are coupled to the support walls (26). The supporting walls (26) are provided with shake preventing portions (27) projecting at positions before the deforming pieces (25). Thus, one side surface of the lock arm (24) contacts the shake preventing portion (27) to restrict shake if the lock arm (24) shakes in widthwise direction due to the contact of an external matter with the lock arm (24), whereby the lock arm (24) can be protected from a damage or the like. Further, the deforming pieces (25) have a sufficient length (L1) for the lock arm (24) is made easily deformable.

14 Claims, 11 Drawing Sheets

CONNECTOR

BACKGROUND OF THE INVENTION

1. Field of the Invention

The invention relates to a connector with a lock arm.

2. Description of the Related Art

Japanese Unexamined Patent Publication No. 2001-319732 and FIGS. 11(A) to 11(C) show known connectors with lock arms supported at both ends. For example, the connector of FIGS. 11(A) to 11(C) has a housing 1, and a lock arm 2 extends back from the front end of the upper surface of the housing 1. Two support walls 3 extend up at a rear part of the housing 1 and are spaced a distance L from the left and right sides of the lock arm 2. Resilient deforming pieces 4 extend to the left and right from a rear end of the lock arm 2, and are coupled integrally to the support walls 3. Thus, the lock arm 2 is supported at both front and rear ends. A lock projection 5 is provided near the longitudinal middle of the lock arm 2 for engaging a mating connector (not shown). The lock arm 2 deforms down as the housing 1 is being connected with the mating connector. However, the lock arm 2 is restored resiliently and the lock projection 5 engages the mating connector to lock the connectors in a properly connected state. The lock arm 2 can be pressed down to disengage the lock projection 5 from the mating connector for separating the connectors.

The deforming pieces 4 of the above-described connector deform as the lock arm 2 is deformed. Accordingly, the lock arm 2 is difficult to deform, if the length L of the deforming pieces 4 is short. Thus, greater forces are required for connecting with a mating connector and for an unlocking operation. This need for greater force reduces operational efficiency. The lock arm 2 is easier to deform if the space between the lock arm 2 and the supporting walls 3 is widened so that the length L of the deforming pieces 4 is long. However, the lock arm 2 then is protected less well. Accordingly, external matter can contact the lock arm 2 and can cause transverse shaking or damage.

The invention was developed in view of the above problems and an object thereof is to provide a connector that ensures efficiency during a connecting operation and an unlocking operation and protecting a lock arm.

SUMMARY OF THE INVENTION

The invention relates to a connector with a housing. A lock arm is formed on the housing and is engageable with a mating connector to hold the connectors together. At least one support wall is formed on the housing at a side of the lock arm, and a resilient deforming piece extends widthwise from the lock arm to the respective supporting wall. At least one shake preventing portion projects from the support wall towards the lock arm at a location near the respective deforming piece for restricting widthwise shaking of the lock arm. The housing preferably has two support walls on opposite respective sides of the lock arm. Deforming pieces preferably extend to each support wall and shake preventing portions are formed on each support wall.

The lock arm preferably extends in a front to rear direction, and the shake preventing portions preferably are before the deforming pieces.

External matter may contact the lock arm and may cause the lock arm to shake in the width direction. However, one side surface of the lock arm will contact the shake preventing portion to restrict the shake and to protect the lock arm from damage. Further, the deforming pieces can have a sufficient length for the lock arm to be easily deformable during a connector connecting operation and an unlocking operation.

The shake preventing portions preferably project over substantially the entire height areas of the support walls.

Projecting end surfaces of the shake preventing portions preferably are substantially parallel with the side surfaces of the lock arm.

A distance between the projecting end surfaces of the shake preventing portions and the side surfaces of the lock arm preferably is shorter than a distance between the rear parts of the support walls and the side surfaces of the lock arm and/or a length of the deforming pieces.

An unlocking projection preferably projects at a rear side of the outer surface of the lock arm, and the lock arm can be deformed towards the housing by pressing the unlocking projection. The unlocking projection preferably has a longitudinal extension longer than a longitudinal extension of the support walls. Additionally, the unlocking projection preferably has a height substantially corresponding to or slightly greater than a height of the support walls.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is described with reference to FIGS. 1 to 10. The connector has a housing 10 that is connectable with a mating housing 40. In the following description, a side (left side in FIG. 1) of the connector to be connected in a connecting direction CD with a mating male connector 40 (see FIG. 3) is referred to as the front. Additionally, the terms up and down are used herein for a convenient frame of reference, and do not imply a required gravitational orientation.

Figure 2:
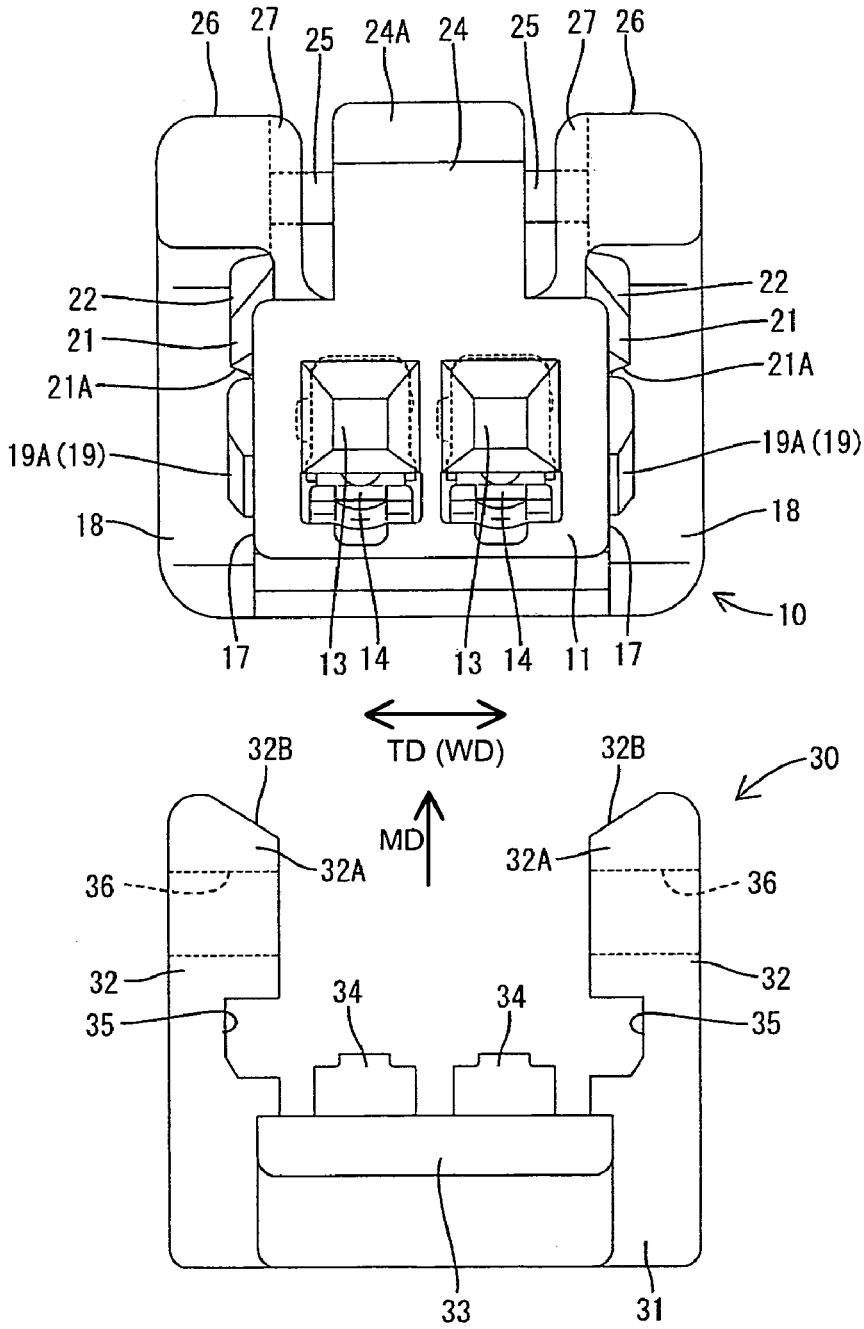
FIG. 2 is an exploded front view of the connector.
Figure 6:
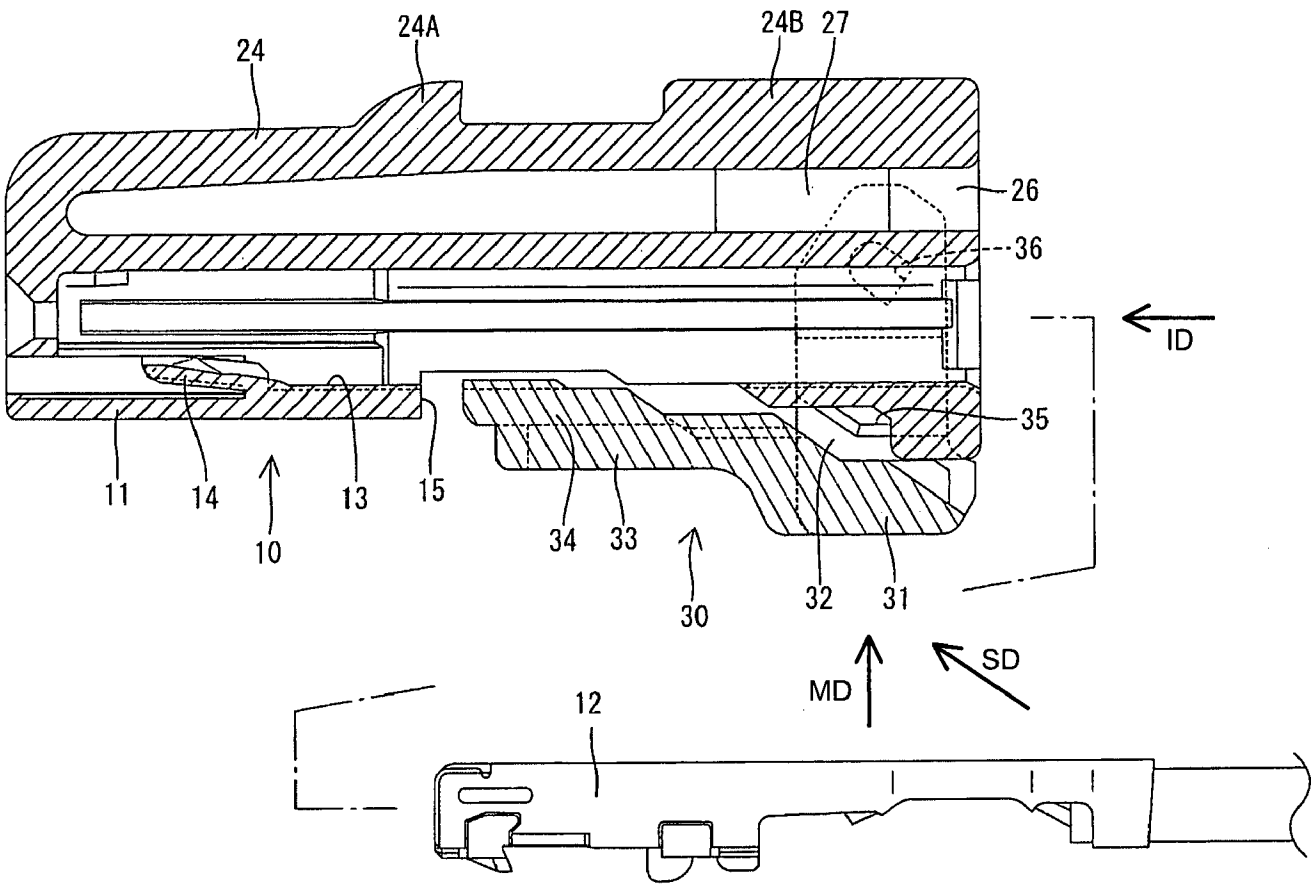
FIG. 6 is a side view in section showing a state where the retainer is mounted at the partial locking position.

The housing 10 is made e.g. of a synthetic resin and includes a main body 11 substantially in the form of a box that is narrow and long in forward and backward directions FBD. Left and right cavities 13 are formed in the main body 11, as shown in FIGS. 2 and 6. The cavities 13 are hollow in forward and backward directions FBD, and female terminal fittings 12 are inserted into the respective cavities 13 in an inserting direction ID through openings at the rear side. Male terminal fittings (not shown) project from the mating connector 40 and enter openings at the front of the cavities 13 for connection with the female terminal fittings 12. A lock 14 is cantilevered obliquely forward from a position on the bottom wall of each cavity 13 close to the front end. The lock 14 is resiliently deformable in a substantially vertical direction that is substantially normal to the inserting direction ID of the terminal fittings 12 into the cavities 13. The lock 14 is engageable with the female terminal fitting 12 to retain the female terminal fitting 12. An insertion hole 15 is so formed in the bottom surface of the main body 11 and communicates with the cavities 13.

Figure 1:
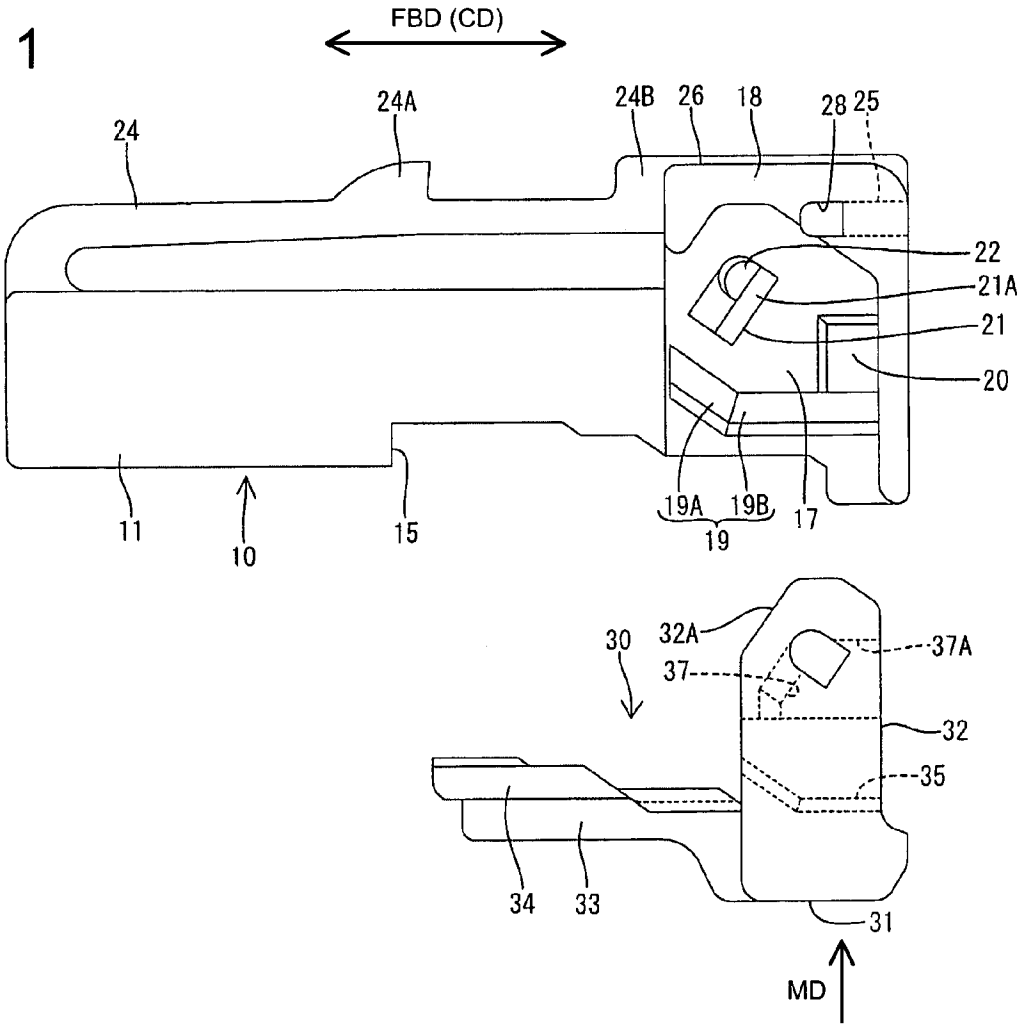
FIG. 1 is an exploded side view of a connector according to one embodiment of the invention.
Figure 4:
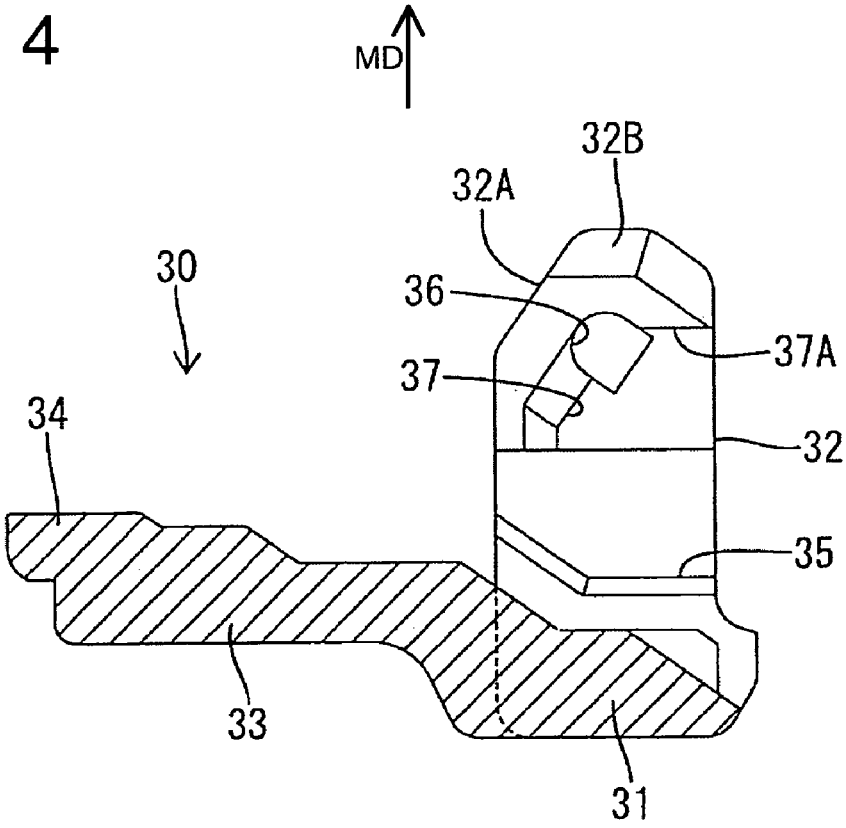
FIG. 4 is a side view in section of a retainer.

The connector also includes a retainer 30 made e.g. of a synthetic resin. The retainer 30 has a plate-shaped coupling 31 that extends along a transverse direction TD, as shown in FIGS. 1, 2 and 4. Two side plates 32 extend up towards the main body 11 from opposite ends of the coupling 31. The side plates 32 are resiliently deformable towards and away from each other along the transverse direction TD. A substantially plate-shaped extension 33 extends forward from the front surface of the coupling 31, and retaining projections 34 project from the upper surface of the extension 33. The retaining projections 34 are narrow and long in forward and backward directions FBD.

Holding recesses 17 are formed in the opposite left and right surfaces of a rear part of the main body 11. The retainer 30 is mounted from below and substantially normal to the forward and backward directions FBD so that the retainer 30 crosses over the housing 10 substantially along the width direction WD and so that the side plates 32 bulge out along width direction WD from the side surfaces of the housing main body 11. Thus, the side plates 32 fit into the left and right holding recesses 17. A protection wall 18 projects at least partly around each holding recess 17 to substantially surround the rear, upper and front upper sides of the side plate 32 of the retainer 30 in the holding recess 17. A guide rib 19 projects at a bottom part of each holding recess 17. Each guide rib 19 has an inclined front portion 19A and a horizontal rear portion 19B. The front portion 19A is inclined up towards the front, preferably at an angle of between about 10° and 55°, whereas the rear portion 19B extends substantially in the forward and backward directions FBD. The bottom edge of each guide rib 19 is slanted. On the other hand, slanted surfaces 32B slope down in at the upper ends of the respective side plates 32 of the retainer 30. The slanted surfaces cooperate so that the side plates 32 can be fit more easily into the holding recesses 17.

Grooves 35 are formed on the inner surfaces of the side plates 32 of the retainer 30 close to the coupling 31 and are configured to receive the guide ribs 19. Each groove 35 has an upper edge that extends substantially horizontally along the forward and backward directions FBD. A front portion of the bottom edge of each groove 35 is inclined up and forward at substantially the same angle as the inclined portion 19A of the guide rib 19. A rear portion of the bottom edge of each groove 35 extends substantially horizontally in forward and backward directions FBD. The front end of the groove 35 has a width measured along a mounting direction MD for closely receiving the inclined portion 19A of the guide rib 19. Thus the retainer 30 is held on the housing 10 by fitting the guide ribs 19 into the grooves 35. More particularly, the retainer 30 is mountable to the housing 10 in the mounting direction MD and is slidable in a sliding direction SD substantially parallel to the inclined portions 19A.

Figure 5:
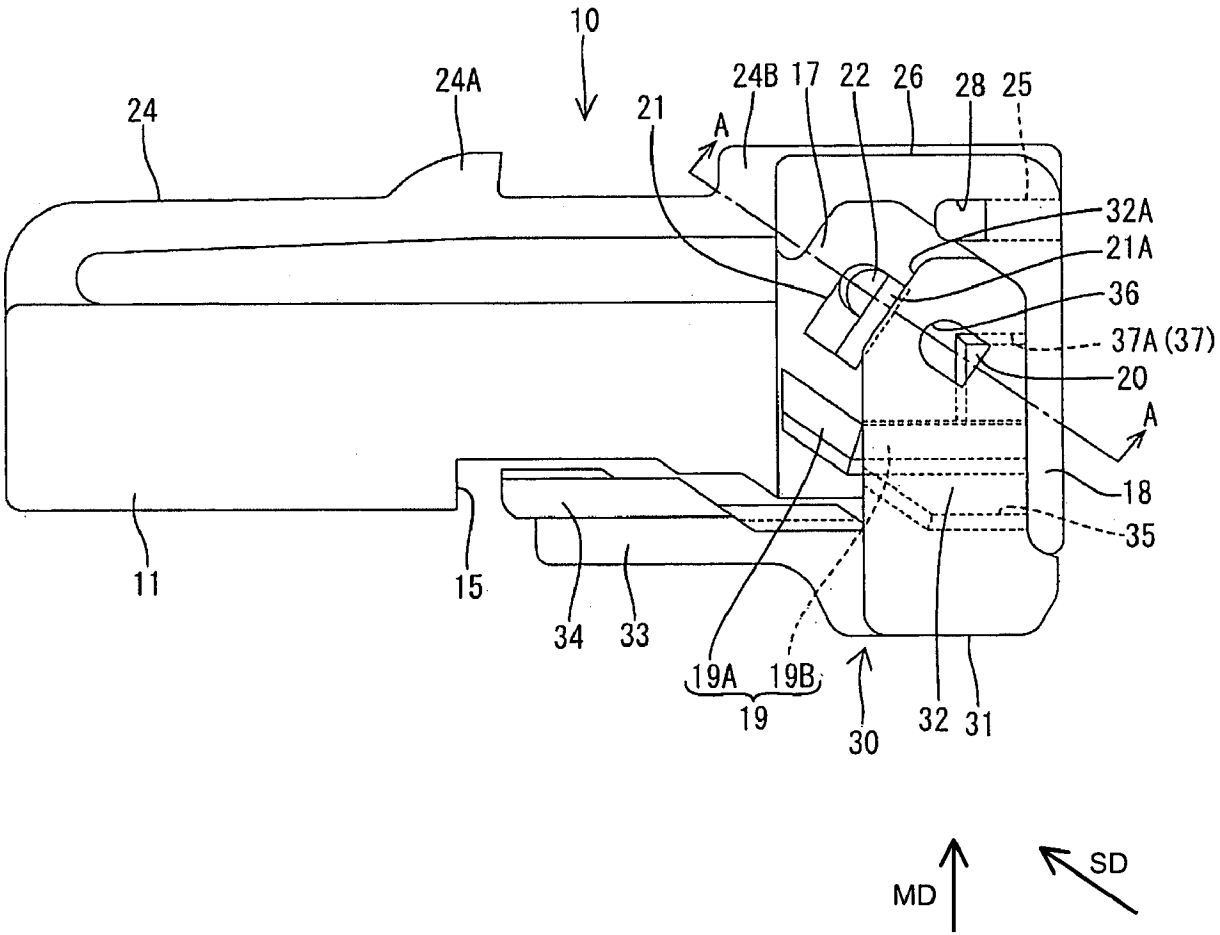
FIG. 5 is a side view showing a state where the retainer is mounted at a partial locking position.

The retainer 30 can be held at a partial locking position at the rear end of the movable range and at a full locking position at the front end of the movable range. The upper edges of the horizontal portions 19B of the guide ribs 19 contact the upper edges of the grooves 35, as shown in FIGS. 5 and 6, when the retainer 30 is at the partial locking position. The retaining projections 34 are retracted from the cavities 13 at this partial locking position to permit insertion and withdrawal of the female terminal fittings 12 into and from the cavities 13.

Figure 9A:
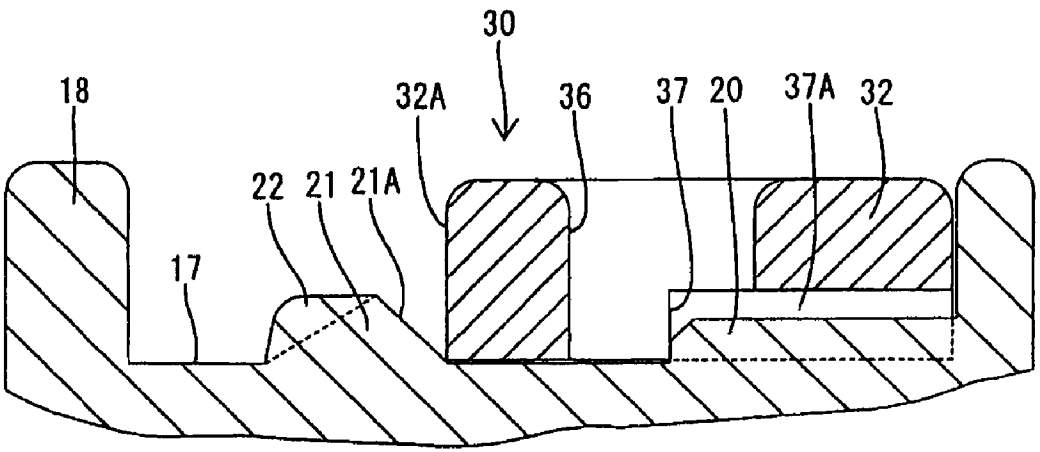
FIGS. 9(A) and 9(B) are a section along 9(A)—9(A) of FIG. 5 and a section along 9(B)—9(B) of FIG. 7.

A substantially rectangular step 20 is formed above the horizontal portion 19B of the guide rib 19 at the rear side of each holding recess 17. On the other hand, a long narrow escaping recess 37 extends in the forward and backward directions FBD on the inner surface of each side plate 32 of the retainer 30. The escaping recess 37 is shallower than the groove 35 and is more toward the leading end than the groove 35. The steps 20 are accommodated in the escaping recesses 37 and upper edges 37A of the escaping recesses 37 engage the upper edges of the steps 20 when the retainer 30 is at the partial locking position, as shown in FIGS. 6 and 9(A). Thus, the posture of the retainer 30 at the partial locking position is stabilized, and the retainer 30 will not incline e.g. in a clockwise direction of FIG. 5 when an external force is exerted on the retainer 30.

Figure 7:
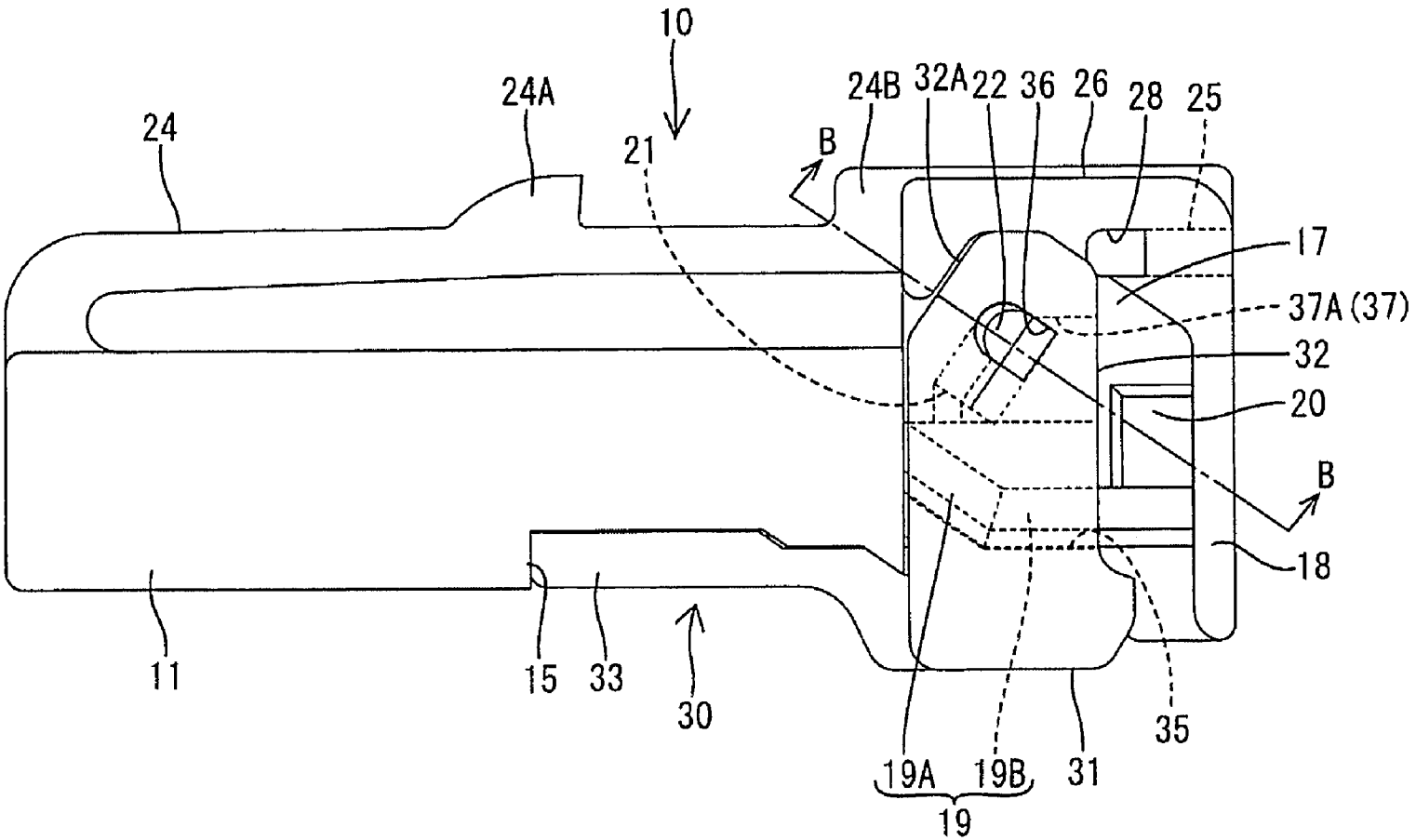
FIG. 7 is a side view showing a state where the retainer is mounted at a full locking position.
Figure 8:
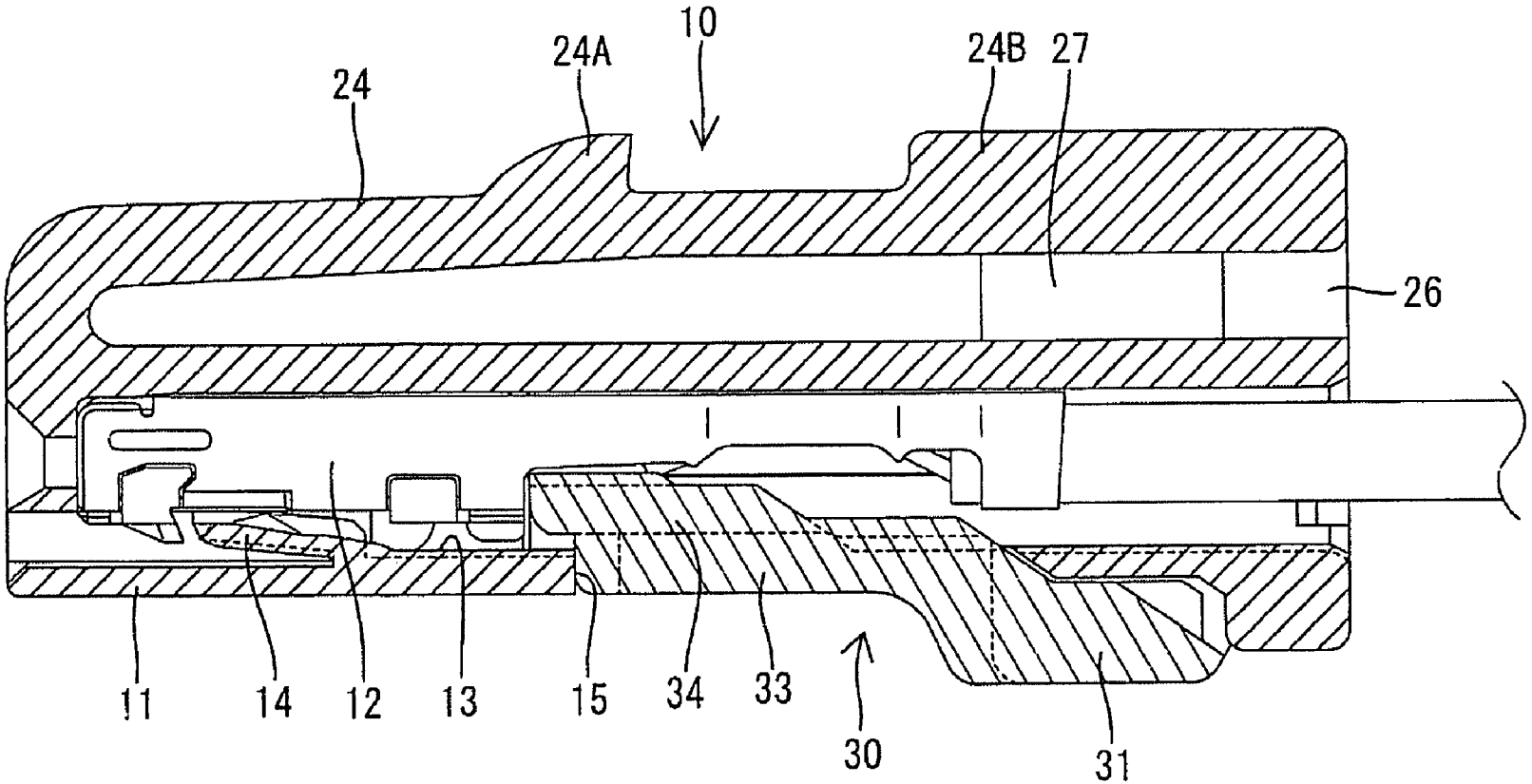
FIG. 8 is a side view in section showing the state where the retainer is mounted at the full locking position.

The bottom edges of the inclined portions 19A and the bottom edges of the horizontal portions 19B of the guide ribs 19 contact the bottom edges of the grooves 35 when the retainer 30 is at the full locking position, as shown in FIGS. 7 and 8. Thus, the retaining projections 34 of the retainer 30 enter the respective cavities 13 from the insertion hole 15 to engage the female terminal fittings 12. As a result, the female terminal fittings 12 are locked doubly.

Figure 9B:
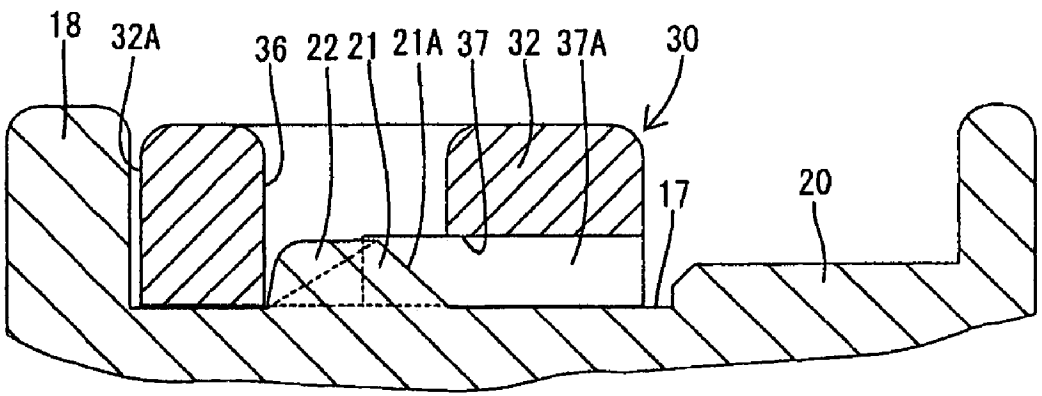

An oblique portion 32A is formed at a front upper side of each side plate 32 of the retainer 30 and is aligned substantially normal to both the inclined portion 19A of the guide rib 19 and the sliding direction SD. On the other hand, a rib 21 is formed in the holding recess 17. The rib 21 has a substantially triangular cross section and extends substantially normal to both the inclined portion 19A of the guide rib 19 and the sliding direction SD. The rib 21 has a slanted rear surface 21A that is higher toward the front along a sliding direction SD of the retainer 30 and extends substantially along the oblique portion 32A of the side plate 32 when the retainer 30 is at the partial locking position. A locking projection 22 is formed at an upper side of the front surface of the rib 21 and has substantially the same height as the tip of the rib 21. A lock hole 36 penetrates each side plate 32 of the retainer 30. As shown in FIG. 9(B), the locking projections 22 engage the lock holes 36 and the ribs 21 enter the escaping recesses 37 when the retainer 30 is at the full locking position.

A lock arm 24 extends back from the front end of the upper surface of the main body 11. Additionally, support walls 26 project up from the left and right sides of the rear part of the main body 11 and define a groove therebetween. A rear part of the lock arm 24 is located in the groove and is spaced apart from the support walls 26 by a specified distance. Upper parts of the mounting recesses 17 and the protection walls 18 are provided at the outer side surfaces of the support walls 26. Thin resilient deforming pieces 25 extend laterally along width direction WD from the rear end of the lock arm 24. Ends of the respective deforming pieces 25 are coupled unitarily to the inner side surfaces at the rear ends of the support walls 26. Thus, the front end of the lock arm 24 is coupled to the front end of the housing main body 11 while the rear end of the lock arm 24 is coupled to the support walls 26 via the deforming pieces 25. Accordingly, the lock arm 24 is supported at both ends and is resiliently displaceable towards and away from the housing 10.

Figure 3:
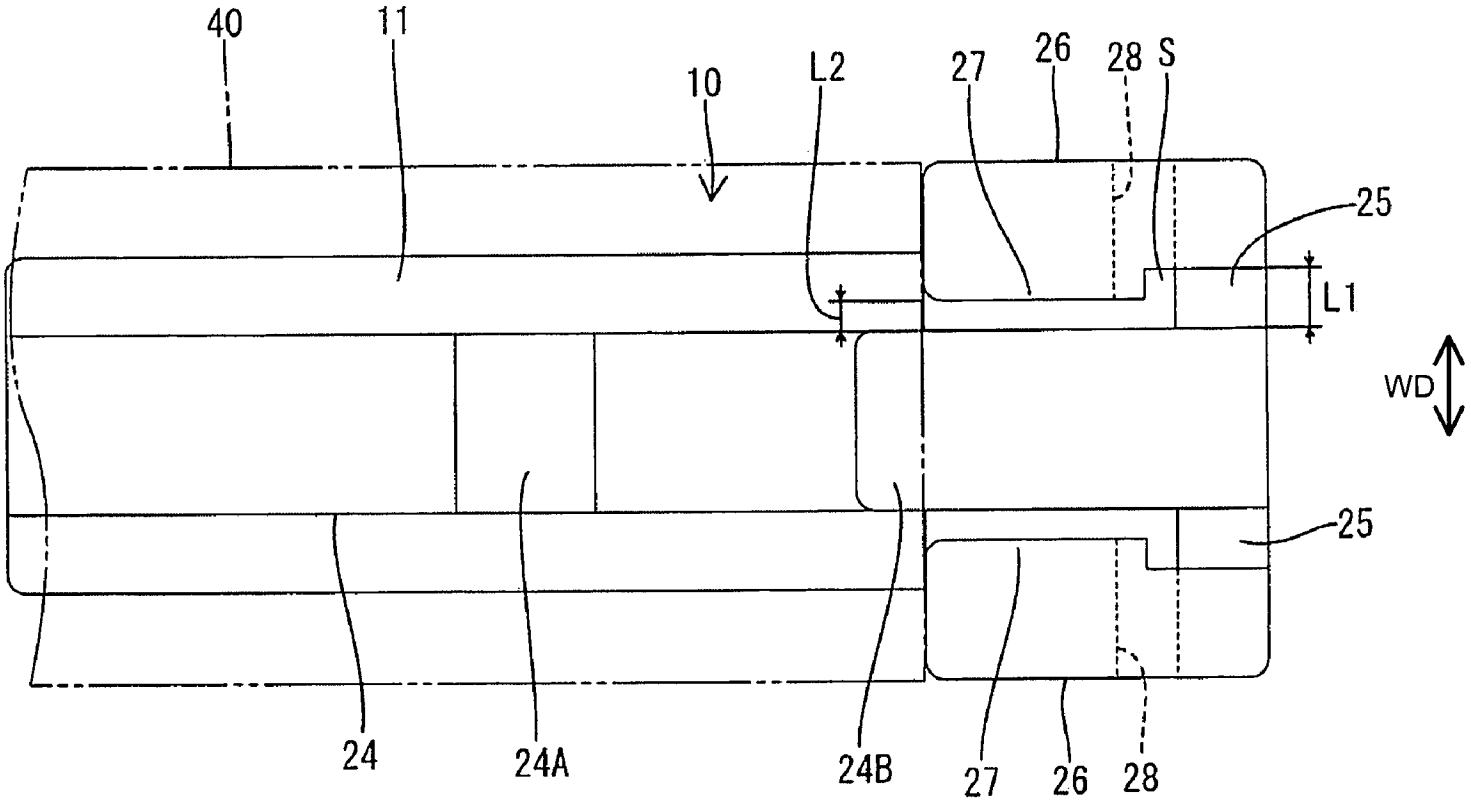
FIG. 3 is a plan view of a housing.

A lock projection 24A projects at a substantially longitudinal middle of the upper surface of the lock arm 24 and is engageable with an engaging portion (not shown) in the mating male connector 40. A part of the main body 11 before the support walls 26 and the holding recesses 17 is fit into a receptacle of the male connector 40, as shown in FIG. 3. The height and width of the housing main body 11 that fit into the male connector 40 are smaller as compared to the corresponding dimensions of the rear part of the housing 10 not fit into the male connector 40, thereby miniaturizing the connectors. A substantially rectangular unlocking projection 24B projects at a rear side of the upper surface of the lock arm 24. A downward pressing force on the unlocking projection 24B will deform the lock arm 24 resiliently down towards the housing 10, thereby disengaging the lock projection 24A from the male connector 40.

Shake preventing portions 27 project toward the lock arm 24 at positions on the inner side surfaces of the left and right support walls 26 before the deforming pieces 25. The shake preventing portions 27 project over substantially the entire height of the inner side surfaces of each support wall 26 and extend in areas from the front ends of the support walls 26 to positions slightly forward of the front ends of the deforming pieces 25 (see FIG. 10). The projecting end surfaces of the shake preventing portions 27 are substantially parallel with the side surfaces of the lock arm 24. Additionally, a distance L2 between the projecting end surfaces of the shake preventing portions 27 and the side surfaces of the lock arm 24 is shorter than a distance L1 between the rear parts of the support walls 26 and the side surfaces of the lock arm 24 as shown in FIG. 3. Thus, if the lock arm 24 shakes in width direction WD for some reason, one side surface of the lock arm 24 contacts the shake preventing portion 27 to restrict the shake of the lock arm 24.

Figure 10:
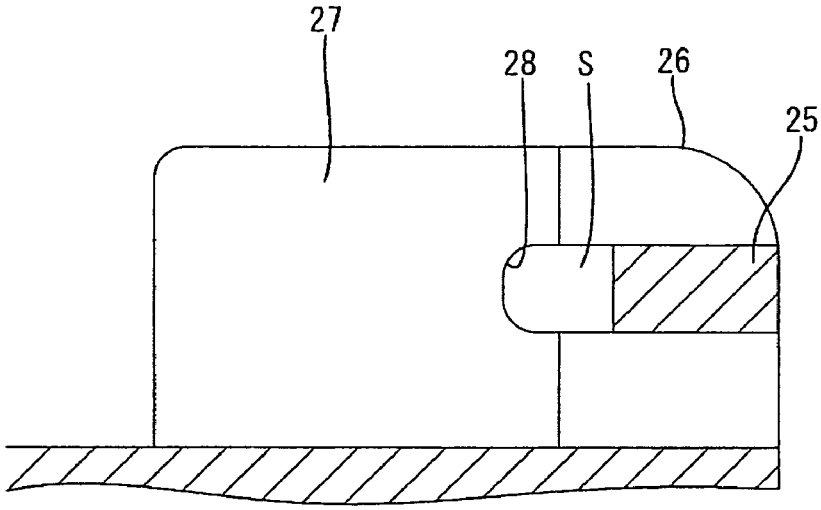
FIG. 10 is a partial enlarged section showing an inner side surface of a supporting wall.
Figure 11A:
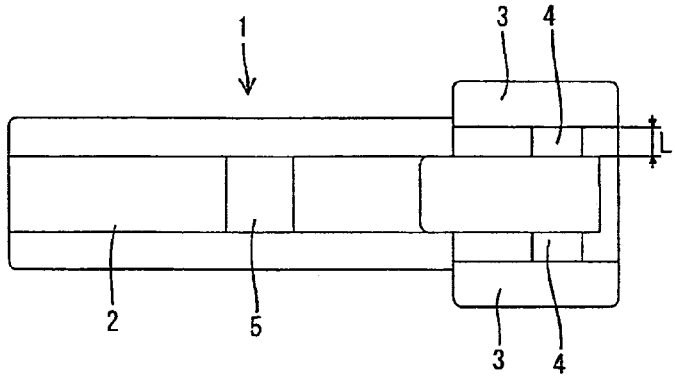
FIG. 11(A) PRIOR ART
FIGS. 11(A), 11(B) and 11(C) are a plan view, a side view and a rear view of a prior art connector.
Figure 11B:
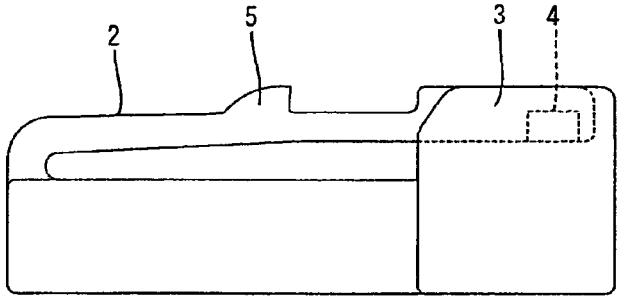
FIG. 11(B) PRIOR ART
Figure 11C:
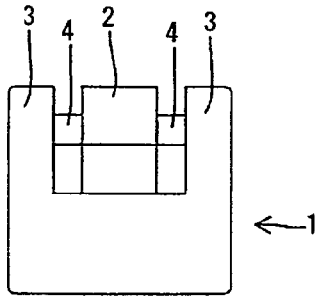
FIG. 11(C) PRIOR ART

Most of the housing 10 is molded by slidable molds moved in the forward and backward directions FBD. However, as also shown in FIG. 10, a space S separates each shake preventing portion 27 and part of the deforming piece 25 near the respective support wall 26. The spaces S cannot be formed by molds that move forward and backward. Accordingly, a mold-removal hole 28 penetrates each support wall 26 in a transverse direction TD from the outer side surface and communicates with the space S. The mold-removal hole 28 also intrudes partly into the shake-preventing portion 27. The mold removal holes 28 and the spaces S are formed by slidable molds removed rightward and leftward in the transverse direction TD.

The connector is assembled by mounting the retainer 30 in the mounting direction MD to the partial locking position with respect to the housing 10 (see FIGS. 5 and 6). The female terminal fittings 12 then are inserted into the cavities 13 of the housing 10 from behind and along the inserting direction ID. The female terminal fitting 12 contacts the respective lock 14 during the insertion process and deforms the lock 14 down. The lock 14 is restored resiliently when the female terminal fitting 12 is inserted to a proper depth to engage and retain the female terminal fitting 12.

The coupling 31 of the retainer 30 then is pushed forward to slide the retainer 30 obliquely up to the front in the sliding direction SD along the inclined portions 19A of the guide ribs 19. Thus, the oblique portions 32A of the side plates 32 slide in contact with the respective slanted surfaces 21A of the ribs 21. As a result, the side plates 32 deform outwardly in the transverse direction TD and move onto the locking projections 22. The side plates 32 are restored resiliently in closing directions and achieve surface contact with the bottom surfaces of the holding recesses 17 when the retainer 30 reaches the full locking position. Thus, the locking projections 22 engage the lock holes 36 (see FIGS. 7 and 8). Further, the retaining projections 34 enter the cavities 13 to engage and doubly lock the respective female terminal fittings 12. In this way, the assembling of the connector is completed.

The housing 10 can be fit into the fitting portion of the male connector 40 from the front and substantially along the forward and backward directions FBD. This fitting operation causes the lock projection 24A of the lock arm 24 to contact the mating connector 40. As a result, the lock arm 24 is pressed down towards the housing 10. The lock arm 24 undergoes an arch-shaped resilient deformation so that a portion of the lock arm 24 near the lock projection 24A reaches a bottommost position. Additionally, sides of the deforming pieces 25 near the lock arm 24 are lowered with respect to sides near the supporting walls 26 and the front ends of the deforming pieces 25 also are twisted slightly.

The lock arm 24 is restored resiliently to its initial posture when the housing 10 is connected with the male connector 40 to a proper depth. As a result, the lock projection 24A engages an engaging portion of the male connector 40 to lock the two connectors together.

The unlocking projection 24B can be pressed down towards the housing 10 to deform the lock arm 24 and to disengage the lock projection 24A from the male connector 40. The two connectors then can be separated.

According to this embodiment, the deforming pieces 25 couple the lock arm 24 to the respective support walls 26. Additionally, the shake preventing portions 27 project from the support walls 26 at positions before the deforming pieces 25. The lock arm 24 may shake in the width direction WD due to contact of external matter with the lock arm 24. However, a side surface of the lock arm 24 will contact the shake preventing portion 27 to restrict the shake and to protect the lock arm 24 from damage. The deforming pieces 25 have a sufficient length L1 for the lock arm 24 to be easily deformable, thereby ensuring easy operation during a connector connecting operation and an unlocking operation.

The distance between the lock arm 24 and the supporting walls 26 is reduced to L2 by the shake preventing portions 27. Thus, external matter is less likely to enter clearances between the lock arm 24 and the support walls 26. In other words, the shake preventing portions 27 prevent external matter from entering between the lock arm 24 and the support wall 26, and therefore help to avoid damage to the lock arm 24.

The invention is not limited to the above described and illustrated embodiment. For example, the following embodiments are also embraced by the technical scope of the present invention as defined by the claims. Beside the following embodiment, various changes can be made without departing from the scope and spirit of the present invention as defined by the claims.

The shape of the shake preventing portions is not limited to the one described and illustrated in the foregoing embodiment. For example, the shaking preventing portions may be narrow and long ribs or locally projecting protuberances. Further, one supporting wall may be provided with a plurality of shake preventing portions.

Although the female connector is illustrated in the foregoing embodiment, the present invention is also applicable to male connectors accommodating male terminal fittings.

Even though the preferred embodiment of the invention refers to a connector having a retainer as a secondary locking means, it should be understood that the invention may be applied to a connector not having a secondary locking means.

What is claimed is:

1. A connector, comprising:

a housing;

a resiliently deformable lock arm formed on the housing and being engageable with a mating connector to hold the connector connected with the mating connector;

at least one support wall formed on the housing to project at least at one side at a rear part of the lock arm;

at least one resilient deforming piece extending from the lock arm substantially along a width direction and coupled to the respective support wall at a support wall coupling; and at least one shake preventing portions projecting from the respective support wall towards the lock arm from a position before the respective deforming piece, a distance from the lock arm to the shake preventing portion in the width direction being less than a distance along the deforming piece from the lock arm to the support wall coupling for restricting shake of the lock arm substantially in the width direction.

2. The connector of claim 1, wherein the lock arm is formed on the housing to extend from a front side to a rear side of a connecting direction.

3. The connector of claim 1, wherein a projecting end surface of the shake preventing portion is substantially parallel with the side surfaces of the lock arm.

4. The connector of claim 1, wherein the housing has opposite front and rear ends, the shake preventing portion being between the resilient deforming piece and the front end of the housing.

5. The connector of claim 1, wherein the shake preventing portion extends from a front end of the support wall to a position forward of a front end of the deforming piece.

6. The connector of claim 1, wherein an unlocking projection projects at a rear side of an outer surface of the lock arm so that the lock arm can be deformed towards the housing by pressing the unlocking projection.

7. The connector of claim 6, wherein the unlocking projection has a longitudinal extension longer than a longitudinal extension of the support wall.

8. The connector of claim 7, wherein the unlocking projection has a height substantially corresponding to a height of the support walls.

9. The connector of claim 1, wherein the at least one support wall comprises first and second support walls projecting at opposite sides at a rear part of the lock arm.

10. The connector of claim 9, wherein the at least one resilient deforming piece comprises first and second resilient deforming pieces extending from the lock arm substantially along the width direction and coupled to the respective first and second support walls at first and second support wall couplings.

11. The connector of claim 10, wherein the at least one shake preventing portion comprises first and second shake preventing portions projection from the respective first and second support walls towards the lock arm from positions before the respective deforming pieces.

12. The connector of claim 11, wherein portions of the lock arm between the support walls have at least one location defining a maximum width in the width direction, the shake preventing portions being spaced from one another by a distance greater than the maximum width of the portions of the lock arm between the support walls, but less than a distance between the first and second support wall couplings.

13. The connector of claim 11, wherein portions of the lock arm between the first and second shake preventing portions have at least one location defining a maximum width in the width direction, the maximum width being less than a minimum distance between the first and second shake preventing portion.

14. A connector comprising:

a housing;

a resiliently deformable lock arm formed on the housing and being engageable with a mating connector to hold the connector connected with the mating connector;

at least one support wall formed on the housing to project at least at one side at a rear part of the lock arm;

at least one resilient deforming piece extending from the lock arm substantially along a width direction and coupled to the respective support wall; and at least one shake preventing portions projecting from the respective support wall towards the lock arm from a position before the respective deforming piece restricting shake of the lock arm substantially in the width direction, wherein the shake preventing portion projects over substantially an entire height of the support wall.

* * * * *